US009099804B2

(12) United States Patent
Suzuki et al.

(10) Patent No.: US 9,099,804 B2
(45) Date of Patent: Aug. 4, 2015

(54) CONNECTOR

(75) Inventors: Masakazu Suzuki, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/350,188

(22) PCT Filed: Apr. 18, 2012

(86) PCT No.: PCT/JP2012/060424

§ 371 (c)(1), (2), (4) Date: Apr. 7, 2014

(87) PCT Pub. No.: WO2013/051304

PCT Pub. Date: Apr. 11, 2013

(65) Prior Publication Data

US 2014/0248787 A1 Sep. 4, 2014

(30) Foreign Application Priority Data

Oct. 6, 2011 (JP) ..... 2011-221547

(51) Int. Cl.
*H01R 13/52* (2006.01)
*H01R 13/436* (2006.01)
*H01R 13/642* (2006.01)

(52) U.S. Cl.
CPC ..... *H01R 13/521* (2013.01); *H01R 13/4361* (2013.01); *H01R 13/642* (2013.01); *H01R 13/5208* (2013.01)

(58) Field of Classification Search
CPC .. H01R 13/40; H01R 13/4361; H01R 13/642; H01R 13/5208; H01R 13/4362; H01R 13/514; H01R 13/422
USPC ..... 439/271
See application file for complete search history.

(56) References Cited

U.S. PATENT DOCUMENTS 5,051,100 A * 9/1991 Kato et al. ..... 439/140
5,232,373 A * 8/1993 Sawada ..... 439/140

(Continued)

FOREIGN PATENT DOCUMENTS

JP 7-57815 3/1995
JP 8-130057 5/1996

(Continued)

OTHER PUBLICATIONS

International Search Report of Jun. 12, 2012.

*Primary Examiner* — Jean F Duverne
(74) *Attorney, Agent, or Firm* — Gerald E. Hespos; Michael J. Porco; Matthew T. Hespos

(57) ABSTRACT

It is aimed to reliably restrict the insertion of a terminal fitting in an improper posture. A connector includes terminal fittings 40 to be inserted into terminal accommodating chambers (13) of a housing (10) successively through through holes (61) of a rubber plug holder (60) and sealing holes (51) of a one-piece rubber plug (50), restricting projections (44) projecting from the outer surfaces of the terminal fittings (40), wires (46) passing through the through holes (61) in a state where the terminal fittings (40) are inserted in the terminal accommodating chambers (13), and restricting portions (17) provided to be located in the terminal accommodating chambers (13) and configured to restrict inserting movements of the terminal fittings (40) by interfering with the restricting projections (44) halfway through when the terminal fittings (40) are inserted in an improper posture into the terminal accommodating chambers (13).

3 Claims, 11 Drawing Sheets

(56) References Cited

U.S. PATENT DOCUMENTS

| | | | | |
|---|---|---|---|---|
| 5,569,051 | A | 10/1996 | Endo et al. | |
| 5,746,628 | A | 5/1998 | Yamamoto | |
| 6,655,999 | B2 * | 12/2003 | Mase et al. | 439/752 |
| 7,011,553 | B2 * | 3/2006 | Hayashi et al. | 439/752 |
| 2006/0141872 | A1 | 6/2006 | Yamakado | |
| 2011/0212654 | A1 | 9/2011 | Suzuki et al. | |

FOREIGN PATENT DOCUMENTS

| | | |
|---|---|---|
| JP | 2006-185759 | 7/2006 |
| JP | 2011-181332 | 9/2011 |

* cited by examiner

CONNECTOR

BACKGROUND

1. Field of the Invention

This invention relates to a connector.

2. Description of the Related Art

Japanese Patent No. 2813620 discloses a connector provided with a housing formed with a plurality of terminal accommodating chambers, a one-piece rubber plug formed with a plurality of sealing holes corresponding to the terminal accommodating chambers and mounted in a rear end part of the housing, a rubber plug holder formed with a plurality of through holes corresponding to the sealing holes and configured to hold the one-piece rubber plug in a mounted state by being mounted to face the rear surface of the one-piece rubber plug, and terminal fittings to be inserted into the terminal accommodating chambers successively through the through holes and the sealing holes.

Each through hole is formed with a recess corresponding to a protrusion on the outer surface of the terminal fitting. When the terminal fitting is inserted in a proper posture, the protrusion passes through the recess and the terminal fitting can be inserted. Further, if it is attempted to insert the terminal fitting in an improper posture (e.g. in an inverted posture), the protrusion interferes with the hole edge of the through hole, thereby hindering an inserting movement of the terminal fitting. As just described, the rubber plug holder is provided with a means for preventing the insertion of the terminal fitting in an improper posture in the connector of Japanese Patent No. 2813620.

In the above connector, when the terminal fitting is inserted into the terminal accommodating chamber, a wire connected to the terminal fitting and drawn out to a back side of the terminal fitting is in a state passed through the through hole. Thus, if the wire has a large diameter and an outer peripheral portion of the wire projects from the outer surface of the terminal fitting when viewed in a direction parallel to an inserting direction of the terminal fitting, a clearance between the inner surface of the through hole and the outer surface of the terminal fitting becomes larger. Even if the means disclosed in patent literature 1 for preventing the insertion of a terminal fitting in an improper posture by the rubber plug holder is applied to such a configuration, an effect of preventing the insertion of a terminal fitting in an improper posture cannot be expected since an engagement margin between the protrusion and the recess is insufficient or cannot be ensured.

The present invention was completed based on the above situation and an object thereof is to reliably restrict the insertion of a terminal fitting in an improper posture.

SUMMARY OF THE INVENTION

To achieve the above object, the present invention is directed to a connector, including a housing formed with a plurality of terminal accommodating chambers; a one-piece rubber plug formed with a plurality of sealing holes corresponding to the terminal accommodating chambers and mounted into a rear end part of the housing; a rubber plug holder formed with a plurality of through hole corresponding to the sealing holes and configured to hold the one-piece rubber plug in a state mounted in the housing by being mounted to face the rear surface of the one-piece rubber plug; terminal fittings to be inserted into the terminal accommodating chambers successively through the through holes and the sealing holes from behind the rubber plug holder; restricting projections projecting from the outer surfaces of the terminal fittings in a direction intersecting with an inserting direction into the terminal accommodating chambers; wires connected to rear end portions of the terminal fittings and passing through the through holes in a state where the terminal fittings are inserted in the terminal accommodating chambers restricting portions provided to be located in the terminal accommodating chambers and configured to restrict an inserting movement of the terminal fitting by interfering with the restricting projection when it is attempted to insert the terminal fitting in an improper posture into the terminal accommodating chamber; fixed interference portions projecting from the inner wall surfaces of the terminal accommodating chambers and constituting the restricting portions; a retainer to be mounted into the housing to be located in the terminal accommodating chambers and displaceable between a partial locking position where the insertion of the terminal fittings into the terminal accommodating chambers is permitted and a full locking position where the retainer comes into contact with the terminal fittings inserted in the terminal accommodating chambers to be able to retain the terminal fittings; and movable interference portions formed on the retainer and constituting the restricting portions when the retainer is at the partial locking position.

In this connector, the restricting portion for restricting the insertion of the terminal fitting in an improper posture into the terminal accommodating chamber is arranged at the position to be located in the terminal accommodating chamber, i.e. at a position located before a movement path for the wire in the process of inserting the terminal fitting. Thus, the shape, position, dimensions and the like of the restricting portion can be suitably set in accordance with the shape, position and dimensions of the restricting portion without being affected by the outer diameter and other dimensions of the wire. Therefore, according to the present invention, the insertion of the terminal fitting in an improper posture can be reliably restricted independently of a relationship between the outer diameter of the wire and the size of the terminal fitting. Further, since the restricting portion is composed of the fixed interference portion on the inner wall surface of the terminal accommodating chamber and the movable interference portion on the retainer in this connector, a sufficient interference margin between the restricting projection and the restricting portion can be ensured.

DETAILED DESCRIPTION OF THE PREFERRED EMBODIMENTS

The connector of the present invention may further include locking lances formed at the inner walls of the terminal accommodating chambers; retaining projections projecting from the outer surfaces of the terminal fittings in a direction intersecting with the inserting direction into the terminal accommodating chambers and configured to retain the terminal fittings inserted in the terminal accommodating chambers by coming into contact with the locking lances; escaping recesses provided to be located in the terminal accommodating chambers and configured to allow the passage of the restricting projections when the terminal fittings are inserted in a proper posture into the terminal accommodating chambers; and inclination suppressing projections projecting from the outer surfaces of the terminal fittings in a direction intersecting with the inserting direction into the terminal accommodating chambers and configured to suppress the inclination of the terminal fittings by coming into contact with the inner surfaces of the escaping recesses in a state where the restricting projections interfere with the restricting portions.

Since the inclination of the terminal fitting is suppressed by the contact of the inclination suppressing projection with the inner surface of the escaping recess in this connector, a reduction in the interference margin of the restricting projection with the restricting portion due to the inclination of the terminal fitting can be prevented.

In the connector of the present invention, only parts of outer peripheral portions of the wires may project from the outer surfaces of the terminal fittings on a virtual projection plane projected in parallel to a passing direction of the terminal fittings through the through holes; and the inner periphery of each through hole may include a wire avoiding recess shaped in conformity with the outer surface of the wire and a terminal positioning recess shaped in conformity with the outer surface of the terminal fitting.

Technical features of this connector are as follows. When a part of the outer peripheral portion of the wire projects from the outer surface of the terminal fitting on the virtual projection plane projected in parallel to the passing direction of the terminal fitting through the through hole, the posture of the terminal fitting in the through hole cannot be fixed if the through hole is formed to have such a rectangular shape as to circumscribe the wire. In that respect, since the wire avoiding recess shaped in conformity with the outer surface of the wire and the terminal positioning recess shaped in conformity with the outer surface of the terminal fitting are formed on the inner periphery of each through hole in this connector, improper inclination of the terminal fitting is prevented by the engagement of the outer peripheral portion of the terminal fittings with the terminal positioning recess.

Figure 1:
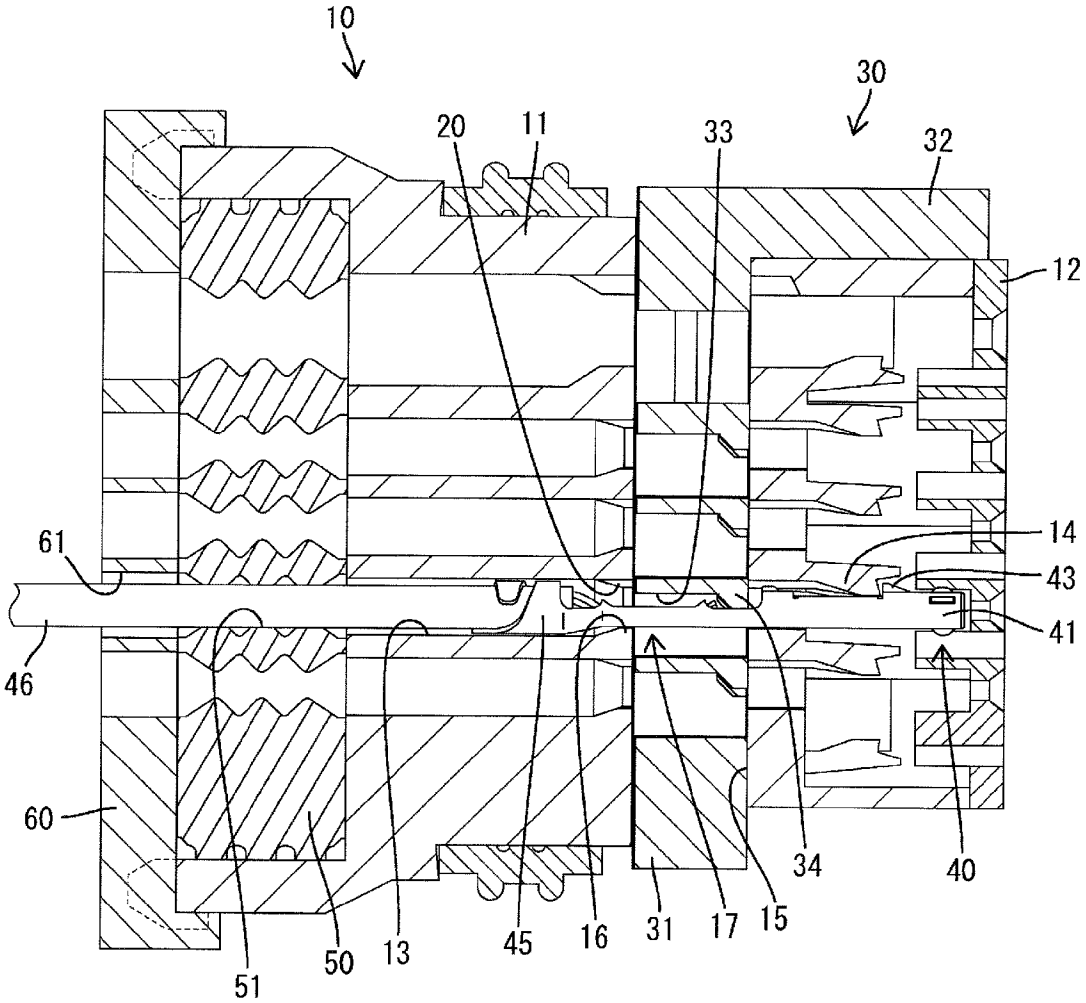
FIG. 1 is a section showing a state where a retainer is at a full locking position in a connector of one embodiment.
Figure 2:
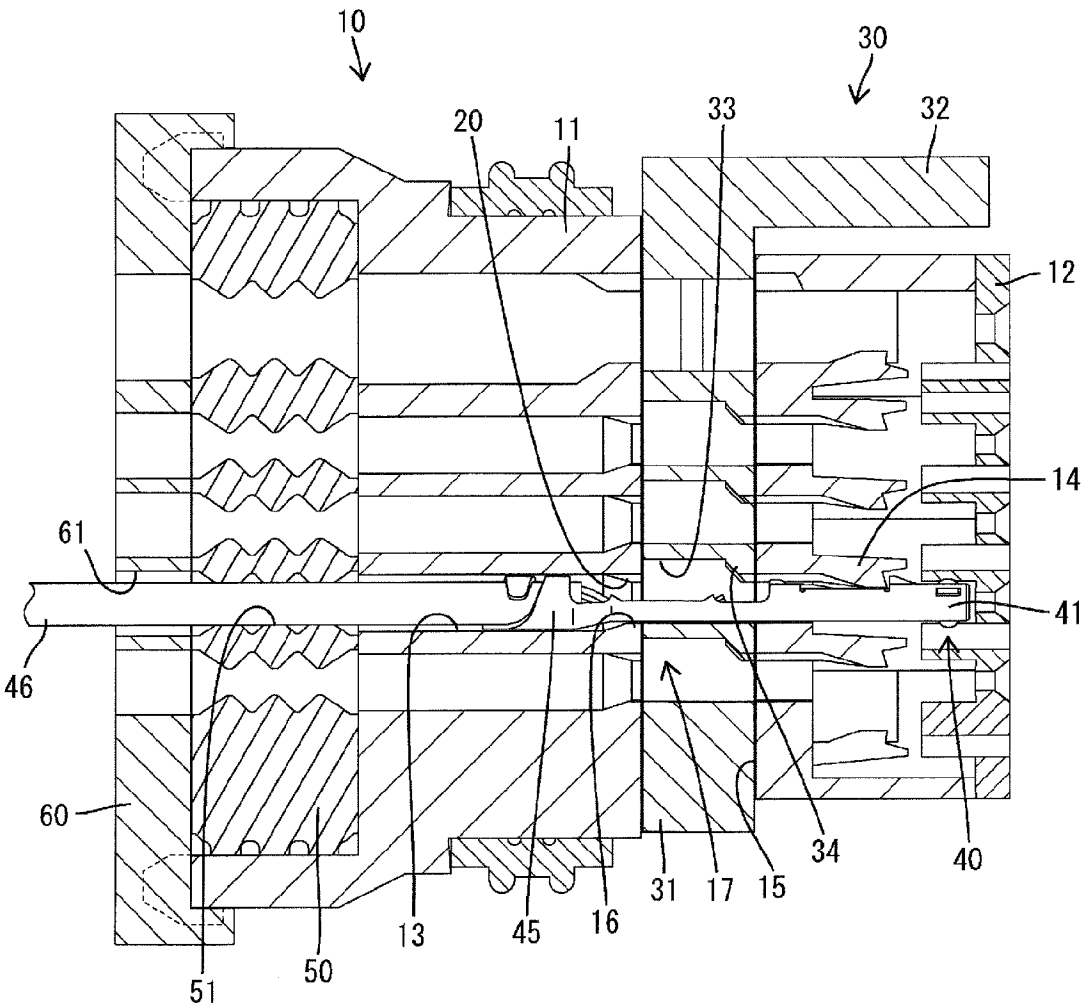
FIG. 2 is a section of the connector showing a state where the retainer is at a partial locking position.

Hereinafter, one specific embodiment of the present invention is described with reference to FIGS. 1 to 11. As shown in FIGS. 1 and 2, a connector of this embodiment includes a housing 10, a retainer 30, a plurality of terminal fittings 40, a plurality of wires 46, a one-piece rubber plug 50 and a rubber plug holder 60. Note that, in the following description, right and left sides in FIGS. 1 and 2 are respectively referred to as front and rear sides concerning forward and backward directions. Further, vertical and lateral directions are based on FIGS. 5 to 11 showing the respective components viewed from behind.

As shown in FIGS. 1 and 2, the housing 10 includes a housing main body 11 and a front member 12 mounted into a front end part of the housing main body 11. A plurality of terminal accommodating chambers 13 penetrating in forward and backward directions are formed in the housing 10. A locking lance 14 cantilevered forward along a lower wall is formed in a front end part of each terminal accommodating chamber 13. The housing 10 is formed with a mounting hole 15 which is open on both upper and lower surfaces. The mounting hole 15 communicates with all the terminal accommodating chambers 13 at a position behind the locking lances 14. The retainer 30 is mounted into the mounting hole 15 from above.

As shown in FIGS. 1, 2, 6, 7 and 9, a fixed interference portion 16 formed by a projecting part of the lower wall of the terminal accommodating chamber 13 behind and adjacent to the mounting hole 15 is formed over the entire width (entire lateral region) of the terminal accommodating chamber 13. The rear surface of the fixed interference portion 16 is inclined upward toward the front. The fixed interference portion 16 is arranged to be located in an insertion path for the terminal fitting 40 in the terminal accommodating chamber 13. Further, the fixed interference portion 16 constitutes a restricting portion 17 together with a movable interference portion 35 to be described later. As shown in FIGS. 6, 7, 9 and 10, the fixed interference portion 16 is formed with a lower interference avoiding recess 18 by substantially semi-circularly cutting a part of the terminal accommodating chamber 13 slightly displaced to the right from a center in a width direction (lateral direction).

Figure 6:
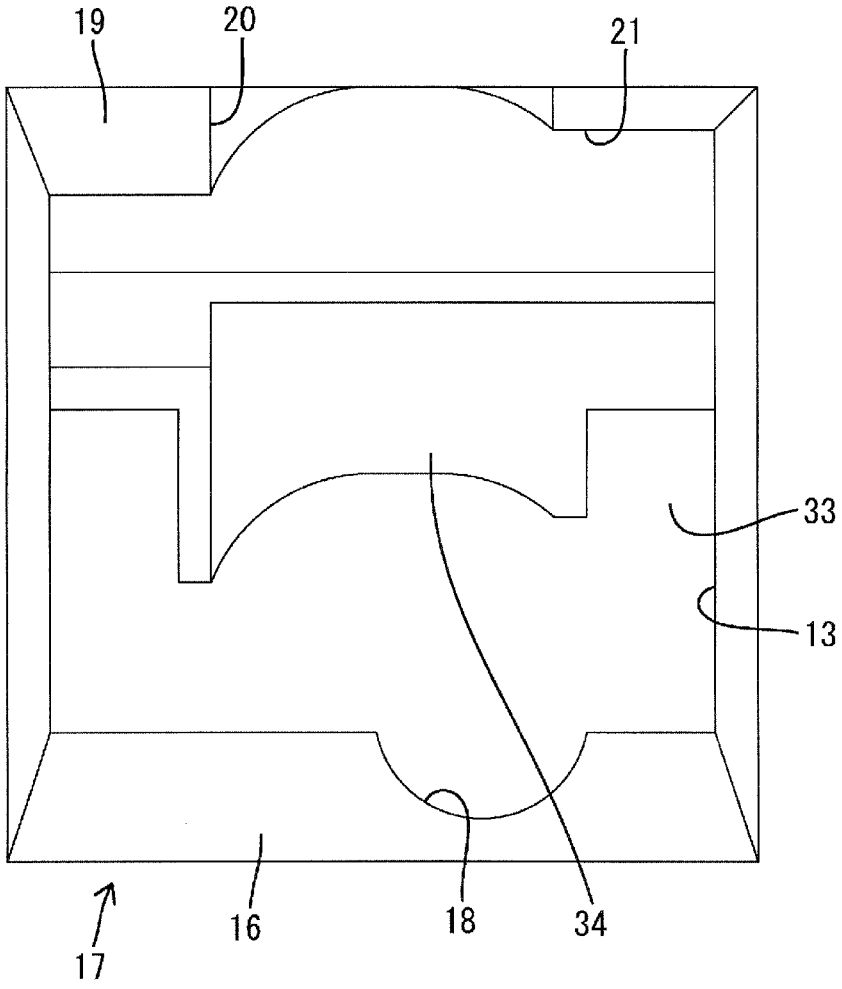
FIG. 6 is a rear view showing a terminal accommodating chamber in the state where the retainer is at the full locking position.
Figure 7:
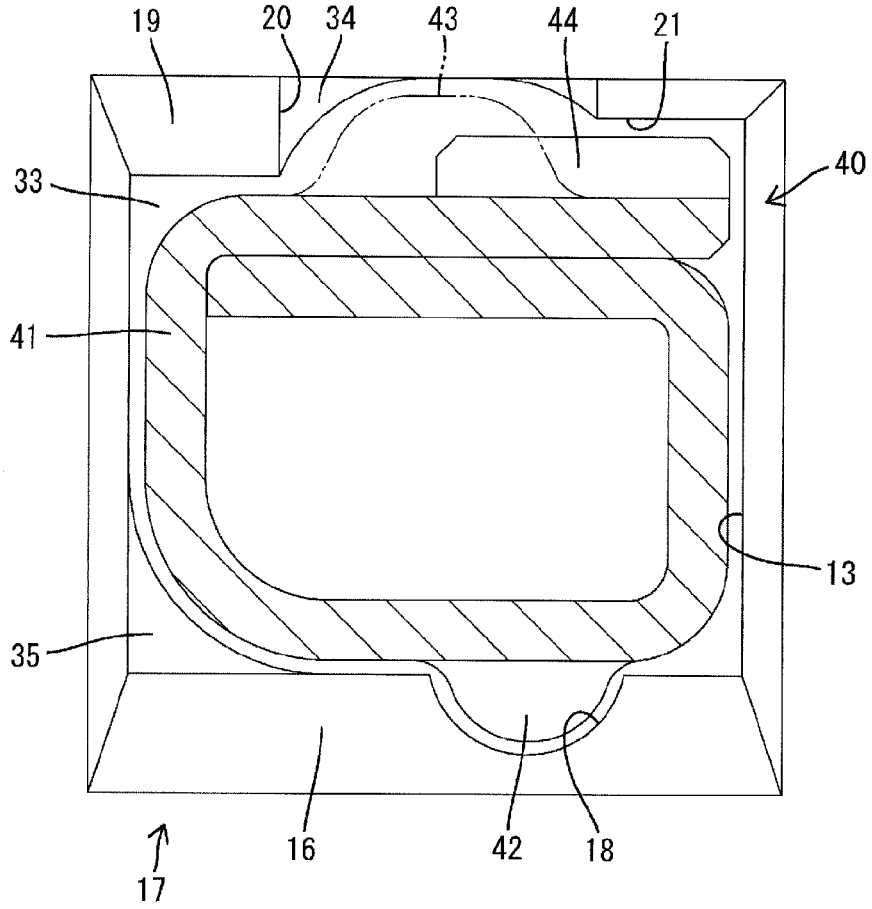
FIG. 7 is a rear view showing a state where the retainer is at the partial locking position and the terminal fitting is inserted in a proper posture in the terminal accommodating chamber.
Figure 8:
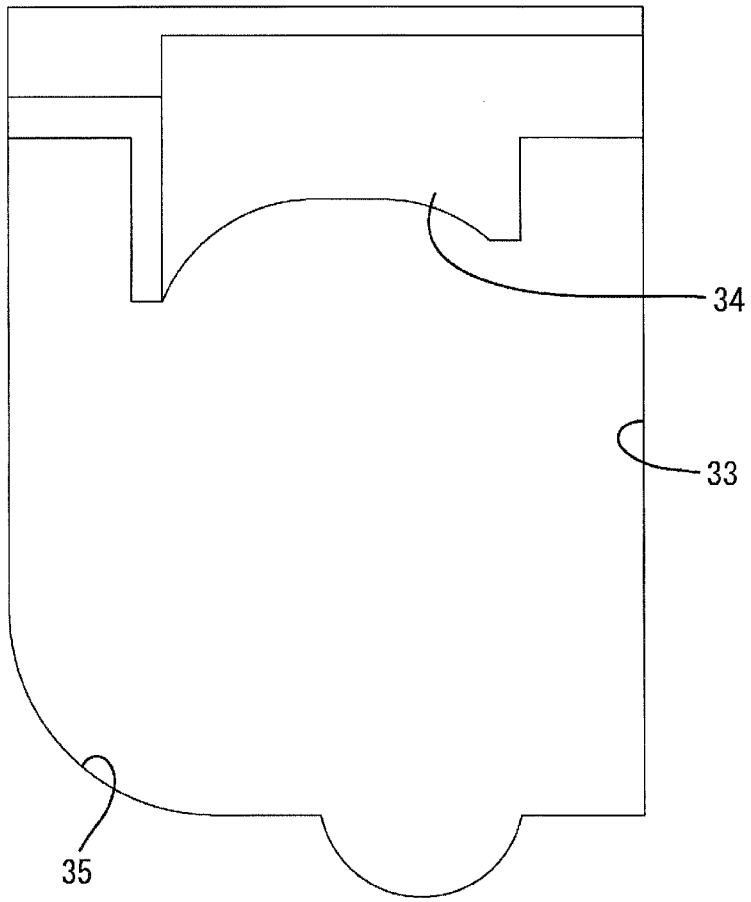
FIG. 8 is a rear view showing the shape of a terminal insertion hole 33 of the retainer.
Figure 9:
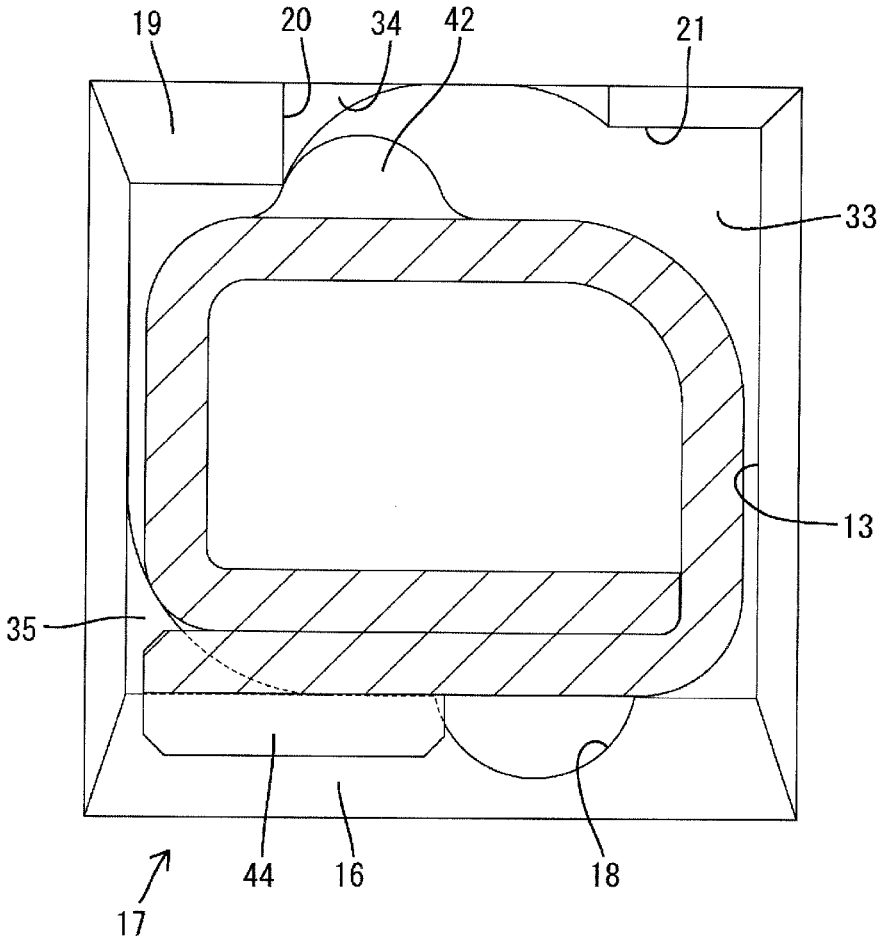
FIG. 9 is a rear view showing a state where the retainer is at the partial locking position and the terminal fitting is inserted in a vertically inverted improper posture in the terminal accommodating chamber.

As shown in FIGS. 6, 7 and 9, a protrusion 19, an escaping recess 20 and an upper interference avoiding recess 21 are formed behind and adjacent to the mounting hole 15 on the upper wall of the terminal accommodating chamber 13. The protrusion 19 is arranged on a left end part of the terminal accommodating chamber 13 in the width direction. The escaping recess 20 is recessed to be located above the lower surface of the protrusion 19 and arranged in a widthwise (lateral) central part of the terminal accommodating chamber 13. The upper interference avoiding recess 21 is recessed up to a height above the lower surface of the protrusion 19 and below the escaping recess 20 and arranged on a right end part of the terminal accommodating chamber 13 in the width direction (lateral direction).

As shown in FIGS. 1 and 2, the retainer 30 is an integral assembly of a main body 31 to be accommodated into the mounting hole 15 and an operating portion 32 extending forward from the upper end edge of the main body 31. The main body 31 is formed with a plurality of terminal insertion holes 33 penetrating in forward and backward directions and corresponding to the respective terminal accommodating chambers 13. As shown in FIGS. 1, 2, 6 and 8, a locking projection 34 is formed on the upper surface of the terminal insertion hole 33. The retainer 30 is held at a partial locking position (see FIGS. 2, 7 and 9) and at a full locking position (see FIGS. 1 and 6) located below the partial locking position in the housing 10.

In a state where the retainer 30 is at the partial locking position on a virtual projection plane of the terminal accommodating chamber 13 viewed from behind in parallel to the inserting direction of the terminal fitting 40 into the terminal accommodating chamber 13 as shown in FIG. 7, an inserting movement of the terminal fitting 40 into the terminal accommodating chamber 13 is permitted since the locking projection 34 is retracted upward from the insertion path for the terminal fitting 40. Likewise, when the retainer 30 is moved to the full locking position on the virtual projection plane, the locking projection 34 moves to be located in the insertion path for the terminal fitting 40 (i.e. further downward from the lower surface of the protrusion 19) and is engaged with the already inserted terminal fitting 40, whereby the retainer 40 is retained.

As shown in FIGS. 7 and 9, the movable interference portion 35 that moves upward (toward the insertion path for the terminal fitting 40) from the upper surface of an area of the fixed interference portion 16 to the left of the lower interference avoiding recess 18 on the above virtual projection plane when the retainer 30 is at the partial locking position is formed on the inner periphery of the terminal insertion hole 33. The movable interference portion 35 is arranged to be located in the insertion path for the terminal fitting 40 in the terminal accommodating chamber 13. When the retainer 30 moves to the full locking position, the movable interference portion 35 moves to a side below the upper surface of the fixed interference portion 16.

Figure 3:
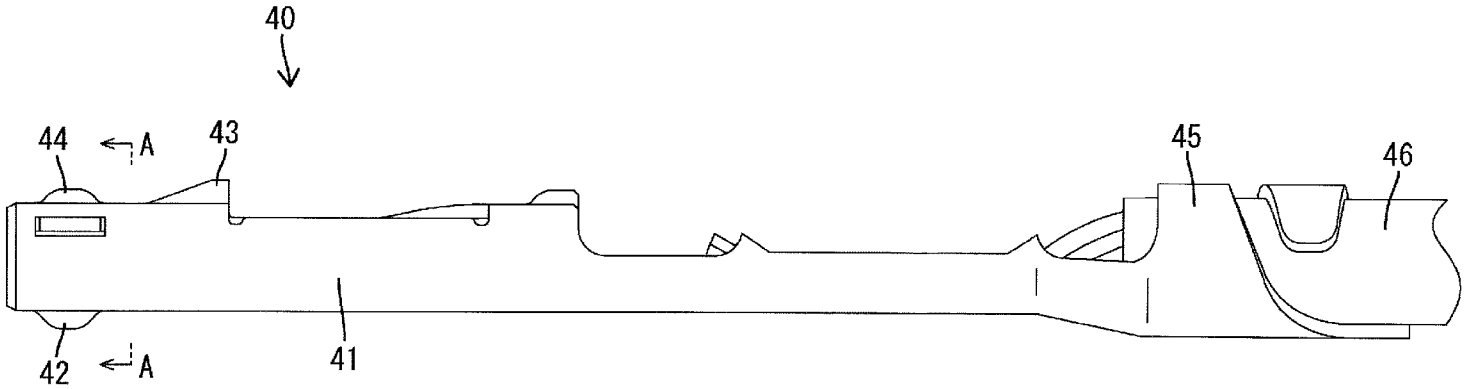
FIG. 3 is a side view of a terminal fitting.

As shown in FIGS. 1 to 4, the terminal fitting is long and narrow in forward and backward directions as a whole and a rectangular tube portion 41 is formed in a front end area of the terminal fitting 40. As shown in FIGS. 3, 5 and 7, an inclination suppressing projection 42 is formed on the lower surface of the rectangular tube portion 41. The inclination suppressing projection 42 is for ensuring an interference margin between the restricting portion 17 and a restricting projection 44 by suppressing the inclination of the terminal fitting 40 when the terminal fitting 40 is inserted in a vertically inverted improper posture into the terminal accommodating chamber 13.

Figure 4:
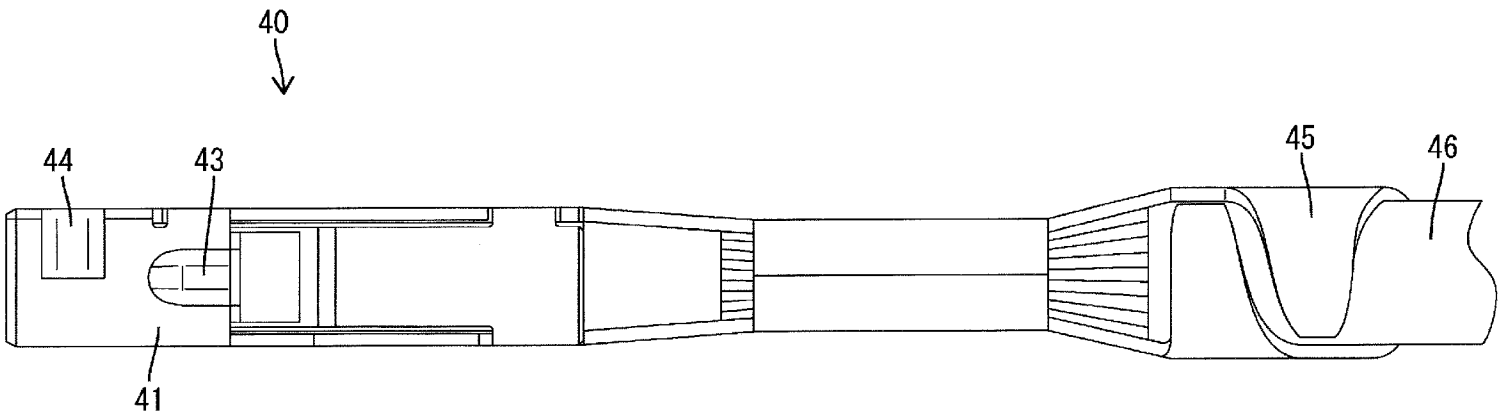
FIG. 4 is a plan view of the terminal fitting.
Figure 5:
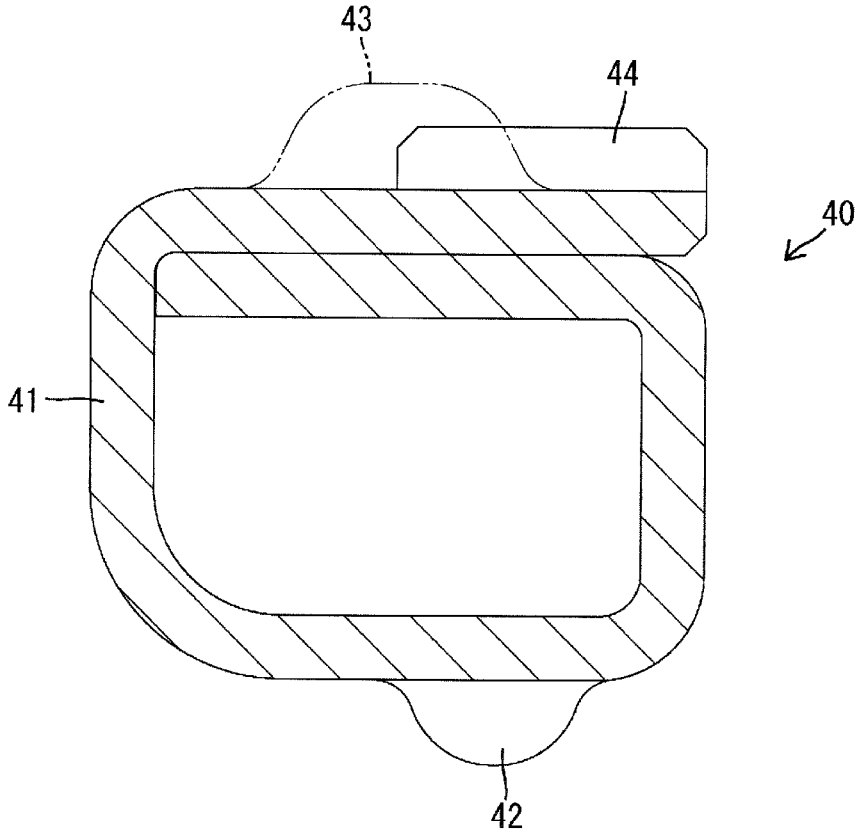
FIG. 5 is a section along A-A of FIG. 3.

As shown in FIGS. 3 to 5 and 7, a retaining projection 43 and the restricting projection 44 are formed on the upper surface of the rectangular tube portion 41. As shown in FIG. 1, the retaining projection 43 retains the terminal fitting 40 by being engaged with the locking lance 14 when the terminal fitting 40 is inserted to a proper position in the terminal accommodating chamber 13. As shown in FIGS. 4, 5 and 7, this retaining projection 43 is arranged at a center position of the rectangular tube portion 41 in the width direction (lateral direction). As shown in FIG. 9, the restricting projection 44 is for restricting an inserting movement of the terminal fitting 40 by interfering with the restricting portion 17 when the terminal fitting 40 is inserted in a vertically inverted improper posture into the terminal accommodating chamber 13. As shown in FIGS. 4, 5 and 7, the restricting projection 44 is arranged at a position displaced to the right from a widthwise center (right half area in the width direction). Further, as shown in FIGS. 3 and 4, the restricting projection 44 is arranged before the retaining projection 43 in forward and backward directions.

Figure 11:
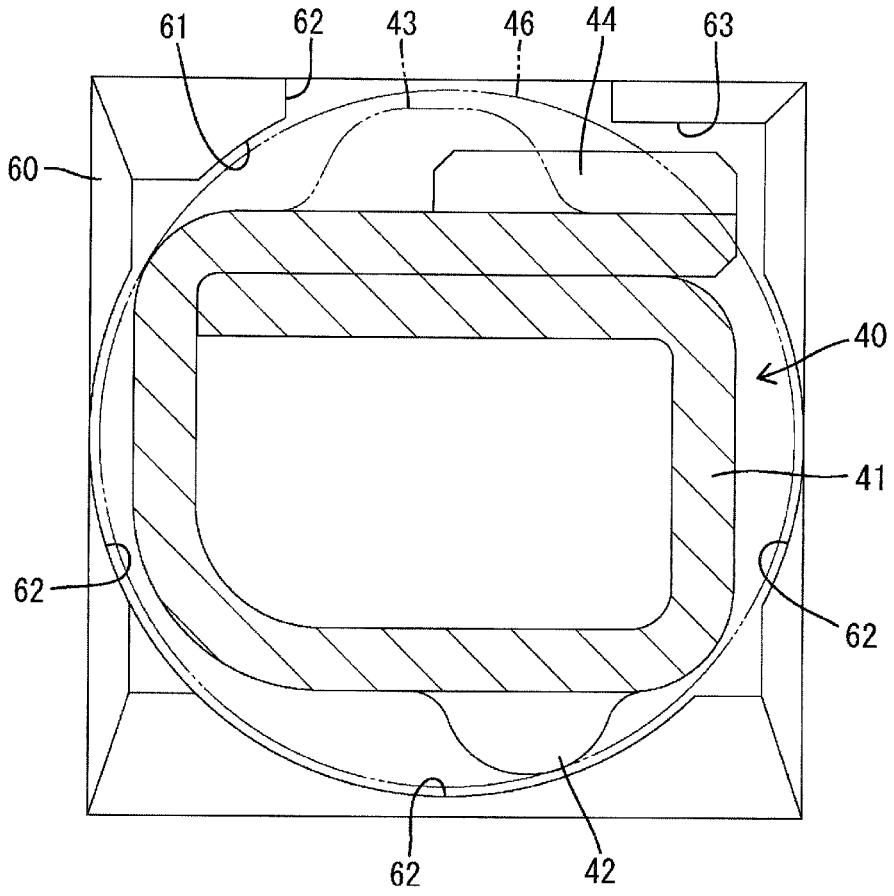
FIG. 11 is a rear view showing a state where a terminal fitting is inserted in a through hole of a rubber plug holder.

As shown in FIGS. 1 to 4, the wire 46 is connected to a wire crimping portion 45 formed in a rear end area of the terminal fitting 40, and the connected wire 46 substantially coaxially extends to a back side of the terminal fitting 40. As shown in FIG. 11, the outer diameter of the wire 46 is larger than vertical and lateral dimensions of the rectangular tube portion 41. Thus, a part of an outer peripheral portion of the wire 46 projects outward from the outer surface of the rectangular tube portion 41 (terminal fitting 40) on a virtual projection plane projected in parallel to a passing direction of the terminal fitting 40 through the through hole 61 of the rubber plug holder 60 to be described later.

As shown in FIGS. 1 and 2, the one-piece rubber plug 50 is mounted in a rear end part of the housing 10. The one-piece rubber plug 50 is formed with a plurality of sealing holes 51 penetrating in forward and backward directions in an arrangement corresponding to the terminal accommodating chambers 13. In the process of inserting the terminal fitting 40 into the terminal accommodating chamber 13, the terminal fitting 40 passes while resiliently deforming and widening the sealing hole 51. In a state where the terminal fitting 40 is properly inserted in the terminal accommodating chamber 13, the wire 46 is held in close contact with the inner periphery of the sealing hole 51 in a liquid-tight manner.

As shown in FIGS. 1 and 2, the rubber plug holder 60 is mounted on the housing 10 to face in contact with or in proximity to the rear surface of the one-piece rubber plug 50. The rubber plug holder 60 is formed with a plurality of through holes 61 penetrating in forward and backward directions in an arrangement corresponding to the sealing holes 51 and the terminal accommodating chambers 13. The rubber plug holder 60 is for holding the one-piece rubber plug 50 in a mounted state to prevent detachment from the housing 10.

The opening of the through hole 61 has a substantially rectangular shape. As shown in FIG. 11, four wire avoiding recesses 62 and one terminal positioning recess 63 are formed by recessing the inner periphery of the through hole 61 on a virtual projection plane projected in parallel to a passing direction of the terminal fitting 40 through the through hole 61. The wire avoiding recesses 62 are formed by arcuately recessing the upper, lower, left and right surfaces of the through hole 61 and shaped in conformity with the outer peripheral shape of the wire 46. The terminal positioning recess 63 is formed by recessing a right upper corner part of the through hole 61. When the terminal fitting 40 is inserted in a proper posture through the through hole 61, the restricting projection 44 passes through the inside of the terminal positioning recess 63. This terminal positioning recess 63 is shaped in conformity with the outer surface (upper and right surfaces) of the restricting projection 44 out of the outer periphery of the terminal fitting 40.

Next, functions of this embodiment are described. The terminal fitting 40 is inserted with the retainer 30 held at the partial locking position. The terminal fitting 40 is accommodated into the terminal accommodating chamber 13 successively through the through hole 61 and the sealing hole 51 from behind the rubber plug holder 60. When the terminal fitting 40 is inserted into the through hole 61, the restricting projection 44 is engaged with the terminal positioning recess 63, whereby the terminal fitting 40 is prevented from being inclined about an axis parallel to the inserting direction, and positioned at a predetermined position. Further, while the terminal fitting 40 is being inserted, the restricting projection 44 passes through the inside of the upper interference avoiding recess 21, the retaining projection 43 passes through the inside of the escaping recess 20, and the inclination suppressing projection 42 passes through the inside of the lower interference avoiding recess 18.

When the terminal fitting 40 is inserted to a proper position, the terminal fitting 40 is retained by the engagement of the locking lance 14 and the retaining projection 43. After the insertion of all the terminal fittings 40 is finished, the retainer 30 is moved to the full locking position. Then, the locking projection 34 is engaged with the rear end edge of the rectangular tube portion 41 to retain the terminal fitting 40.

If the terminal fitting 40 is inserted in a vertically inverted improper posture, the restricting projection 44 comes into contact with the fixed interference portion 16 constituting the restricting portion 17 and any further inserting movement of the terminal fitting 40 is restricted by this contact of the restricting projection 44 as shown in FIG. 9 when a front end part of the rectangular tube portion 41 enters the terminal insertion hole 33 of the retainer 30. Further, the inclination suppressing projection 42 enters the escaping recess 20 and comes into contact with the left inner surface of the escaping recess 20, i.e. the right outer surface of the protrusion 19 and the inclination of the terminal fitting 40 in a counterclockwise direction (rotation about an axis parallel to the inserting direction of the terminal fitting 40) is restricted.

Figure 10:
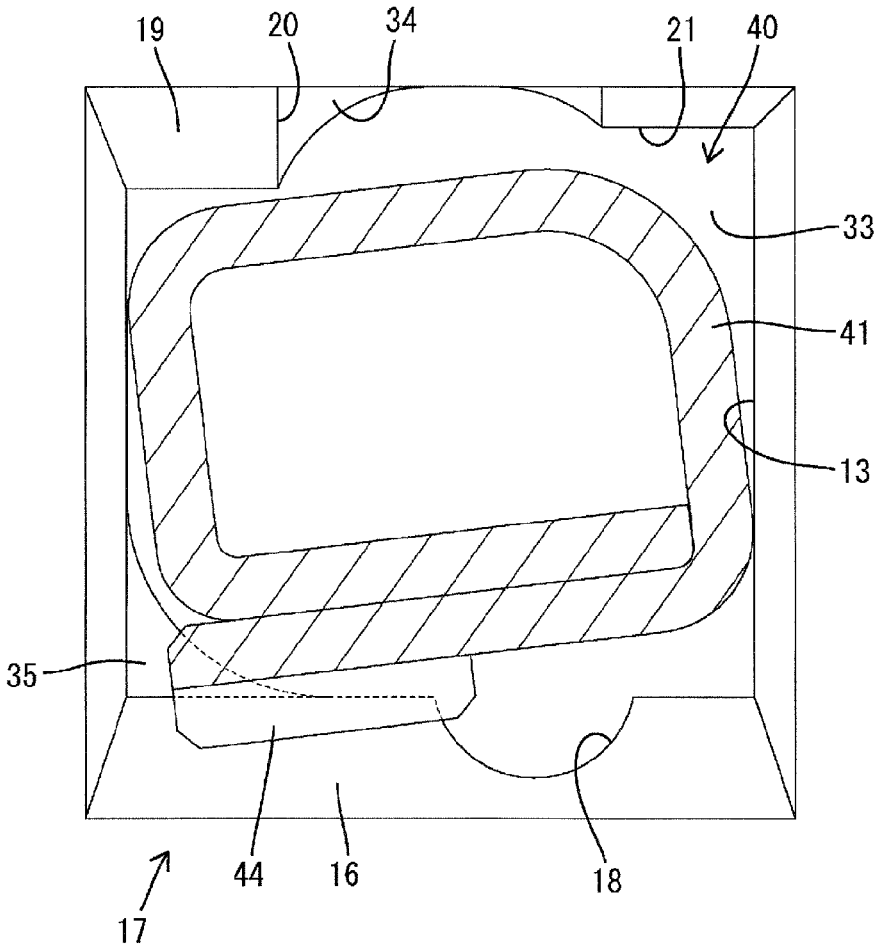
FIG. 10 is a rear view showing a virtual state where the terminal fitting is inclined because not being formed with an inclination suppressing projection 42.

If the inclination suppressing projection 42 is not formed, the reliability of a function of restricting the insertion of the terminal fitting 40 in an improper posture is reduced since the terminal fitting 40 is largely inclined and an interference margin between the restricting projection 44 and the fixed interference portion 16 decreases as shown in FIG. 10. Contrary to this, since the inclination of the terminal fitting 40 is suppressed in this embodiment, a sufficiently large interference margin between the restricting projection 44 and the fixed interference portion 16 can be ensured.

Further, the rear surface of the fixed interference portion 16 is an inclined surface for allowing the terminal fitting 40 inserted in a proper posture to be smoothly inserted. Thus, if the terminal fitting 40 is excessively strongly pushed, the restricting projection 44 may move forward while being rubbed against the inclined surface and the terminal fitting 40 may be inserted in an improper posture. However, since the movable interference portion 35 is present at the front side (back side in the inserting direction) of the fixed interference portion 16, the restricting projection 44 comes into contact with this movable interference portion 35 and the insertion of the terminal fitting 40 in an improper posture is prevented.

As described above, the connector of the embodiment includes the housing 10 formed with the plurality of terminal accommodating chambers 13, the one-piece rubber plug 50 formed with the plurality of sealing holes 51 corresponding to the terminal accommodating chambers 13, the rubber plug holder 60 formed with the plurality of through holes 61 corresponding to the sealing holes 51, the terminal fittings 40 to be inserted into the terminal accommodating chambers 13 successively through the through holes 61 and the sealing holes 51 from behind the rubber plug holder 60, the restricting projections 44 projecting from the outer surfaces of the terminal fittings 40 in a direction intersecting with the inserting direction into the terminal accommodating chambers 13, the wires 46 connected to the rear end parts of the terminal fittings 40 and passing through the through holes 61 in the state where the terminal fittings 40 are inserted in the terminal accommodating chambers 13, and the restricting portions 17 provided to be located in the terminal accommodating chambers 13 and configured to restrict inserting movements of the terminal fittings 40 by interfering with the restricting projections 44 when the terminal fittings 40 are inserted in an improper posture into the terminal accommodating chambers 13.

According to this configuration, the restricting portion 17 for restricting the insertion of the terminal fitting 40 in an improper posture into the terminal accommodating chamber 13 is arranged at a position to be located in the terminal accommodating chamber 13, i.e. at a position before a movement path for the wire 46 in the process of inserting the terminal fitting 40. Thus, the shape, position, dimensions and the like of the restricting portion 17 can be suitably set in accordance with the shape, position and dimensions of the restricting portion 44 without being affected by the outer diameter and other dimensions of the wire 46. Therefore, according to this embodiment, the insertion of the terminal fitting 40 in an improper posture can be reliably restricted independently of a relationship between the outer diameter of the wire 46 and the size of the terminal fitting 40.

Further, the connector of this embodiment includes the fixed interference portions 16 projecting from the inner wall surfaces of the terminal accommodating chambers 13 and constituting the restricting portions 17, the retainer 30 to be mounted in the housing 10 to be located in the terminal accommodating chambers 13 and displaceable between the partial locking position where the insertion of the terminal fittings 40 into the terminal accommodating chambers 13 is permitted and the full locking position where the retainer 30 comes into contact with the terminal fittings 40 inserted in the terminal accommodating chambers 13 to be able to retain the terminal fittings 40, and the movable interference portions 35 formed on the retainer 30 and constituting the restricting portions 17 when the retainer 30 is at the partial locking position. Since the restricting portion 17 is composed of the fixed interference portion 16 on the inner wall surface of the terminal accommodating chamber 13 and the movable interference portion 36 of the retainer 30, a sufficiently large interference margin between the restricting projection 44 and the restricting portion 17 can be ensured.

Further, the connector includes the locking lances 14 formed at the inner walls of the terminal accommodating chambers 13, the retaining projections projecting from the outer surfaces of the terminal fittings 40 in the direction intersecting with the inserting direction into the terminal accommodating chambers 13 and configured to retain the terminal fittings 40 inserted in the terminal accommodating chambers 13 by coming into contact with the locking lances 14, the escaping recesses 20 provided to be located in the terminal accommodating chambers 13 and configured to allow the passage of the retaining projections 43 when the terminal fittings 40 are inserted in a proper posture into the terminal accommodating chambers 13, and the inclination suppressing projections 42 projecting from the outer surfaces of the terminal fittings 40 in the direction intersecting with the inserting direction into the terminal accommodating chambers 13 and configured to suppress the inclination of the terminal fittings 40 by coming into contact with the inner surfaces of the escaping recesses 20 in a state where the restricting projections 44 interfere with the restricting portions 17. According to this configuration, since the inclination of the terminal fittings 40 is suppressed by the contact of the inclination suppressing projections 42 with the inner surfaces of the escaping recesses 20, a reduction in the interference margins of the restricting projections 44 with the restricting portions 17 due to the inclination of the terminal fittings 40 can be prevented.

Further, in this embodiment, only a part of the outer peripheral portion of the wire 46 projects from the outer surface of the terminal fitting 40 on the virtual projection plane projected in parallel to the passing direction of the terminal fitting 40 through the through hole 61. In this case, if the through hole 61 is formed to have such a rectangular shape as to circumscribe the wire 46, the posture of the terminal fitting 40 cannot be fixed in the through hole 61. Accordingly, in this embodiment, the wire avoiding recesses 62 shaped in conformity with the outer surface of the wire 46 and the terminal positioning recess 63 shaped in conformity with the outer surface of the terminal fitting 40 are formed on the inner periphery of the through hole 61. This prevents the terminal fitting 40 from being inclined into an improper posture by the engagement of the outer peripheral portion of the terminal fitting 40 with the terminal positioning recess 63.

The present invention is not limited to the above described and illustrated embodiment. For example, the following embodiments are also included in the technical scope of the present invention.

(1) Although the restricting portion is composed of the fixed interference portion formed on the inner wall surface of the terminal accommodating chamber and the movable interference portion formed on the retainer in the above embodiment, it may be formed only on the inner wall surface of the terminal accommodating chamber or only on the retainer.

(2) Although the connector provided with the retainer is described in the above embodiment, the present invention can also be applied to a connector not provided with a retainer.

(3) Although the escaping recess also having a function of suppressing the inclination of the terminal fitting is formed only on the inner wall surface of the terminal accommodating chamber in the above embodiment, the escaping recess also having the function of suppressing the inclination of the terminal fitting may be formed on both the terminal accommodating chamber and the retainer or only on the retainer.

(4) Although the escaping recess for avoiding interference with the retaining projection as the means for retaining the retainer also has a function as a means for suppressing the inclination of the terminal fitting in the above embodiment, the escaping recess may not have the function of suppressing the inclination of the terminal fitting according to the present invention. In this case, a dedicated inclination suppressing means may be provided in addition to the escaping recess as the means for suppressing the inclination of the terminal fitting.

The invention claimed is:

1. A connector, comprising:

a housing formed with a plurality of terminal accommodating chambers;

a one-piece rubber plug formed with a plurality of sealing holes corresponding to the terminal accommodating chambers and mounted into a rear end part of the housing;

a rubber plug holder formed with a plurality of through hole corresponding to the sealing holes and configured to hold the one-piece rubber plug in a state mounted in the housing by being mounted to face the rear surface of the one-piece rubber plug;

terminal fittings to be inserted into the terminal accommodating chambers successively through the through holes and the sealing holes from behind the rubber plug holder;

restricting projections projecting from the outer surfaces of the terminal fittings in a direction intersecting with an inserting direction into the terminal accommodating chambers;

wires connected to rear end portions of the terminal fittings and passing through the through holes in a state where the terminal fittings are inserted in the terminal accommodating chambers;

restricting portions provided to be located in the terminal accommodating chambers and configured to restrict an inserting movement of the terminal fitting by interfering with the restricting projection when it is attempted to insert the terminal fitting in an improper posture into the terminal accommodating chamber;

fixed interference portions projecting from the inner wall surfaces of the terminal accommodating chambers and constituting the restricting portions;

a retainer to be mounted into the housing to be located in the terminal accommodating chambers and displaceable between a partial locking position where the insertion of the terminal fittings into the terminal accommodating chambers is permitted and a full locking position where the retainer comes into contact with the terminal fittings inserted in the terminal accommodating chambers to be able to retain the terminal fittings; and movable interference portions formed on the retainer and constituting the restricting portions when the retainer is at the partial locking position.

2. The connector of claim 1, further comprising:

locking lances formed at the inner walls of the terminal accommodating chambers;

retaining projections projecting from the outer surfaces of the terminal fittings in a direction intersecting with the inserting direction into the terminal accommodating chambers and configured to retain the terminal fittings inserted in the terminal accommodating chambers by coming into contact with the locking lances;

escaping recesses provided to be located in the terminal accommodating chambers and configured to allow the passage of the restricting projections when the terminal fittings are inserted in a proper posture into the terminal accommodating chambers; and inclination suppressing projections projecting from the outer surfaces of the terminal fittings in a direction intersecting with the inserting direction into the terminal accommodating chambers and configured to suppress the inclination of the terminal fittings by coming into contact with the inner surfaces of the escaping recesses in a state where the restricting projections interfere with the restricting portions.

3. The connector of claim 1, wherein:

only parts of outer peripheral portions of the wires project from the outer surfaces of the terminal fittings on a virtual projection plane projected in parallel to a passing direction of the terminal fittings through the through holes; and the inner periphery of each through hole includes a wire avoiding recess shaped in conformity with the outer surface of the wire and a terminal positioning recess shaped in conformity with the outer surface of the terminal fitting.

* * * * *